United States Patent [19]

Galton

[11] 3,992,068

[45] Nov. 16, 1976

[54] DEVICE FOR STOCKING, FILING AND DISPLAYING SMALL ARTICLES

[76] Inventor: Renée Galton, 7, rue Fallempin, Paris, France, 75015

[22] Filed: July 23, 1973

[21] Appl. No.: 381,699

[52] U.S. Cl. ..... 312/202; 211/78; 248/DIG. 3; 312/135

[51] Int. Cl.[2] ..... A47F 5/02

[58] Field of Search ..... 211/77, 78, 95, 167, 211/140; 312/135, 197, 202, 234.1, 252, 319; 248/131, DIG. 3

[56] References Cited

UNITED STATES PATENTS

| | | | |
|---|---|---|---|
| 112,277 | 2/1871 | Phillips | 312/135 |
| 483,469 | 9/1892 | Mosser | 312/135 |
| 743,429 | 11/1903 | Benbow | 312/202 |
| 1,929,677 | 10/1933 | Davis | 312/202 |
| 1,947,325 | 2/1934 | Bailey | 211/95 |
| 2,639,957 | 5/1953 | Geller | 312/319 |
| 3,417,873 | 12/1968 | Leptrone | 211/77 |
| 3,693,807 | 9/1972 | Larson | 211/78 |

*Primary Examiner*—Casmir A. Nunberg
*Attorney, Agent, or Firm*—Donald D. Jeffery

[57] ABSTRACT

Device designed for stocking, filing by series, and displaying small articles. It consists of a fixed base, and a rotating frame composed of two types of superimposed discs which are perforated in the center to receive a threaded rod for rotating the discs relative to the fixed base. The discs are divided into compartments, which are themselves separated by thin metallic rods, thus forming divisions into which cases or drawers can be inserted, thus permitting stocking by series of small articles.

6 Claims, 4 Drawing Figures

FIG. 1
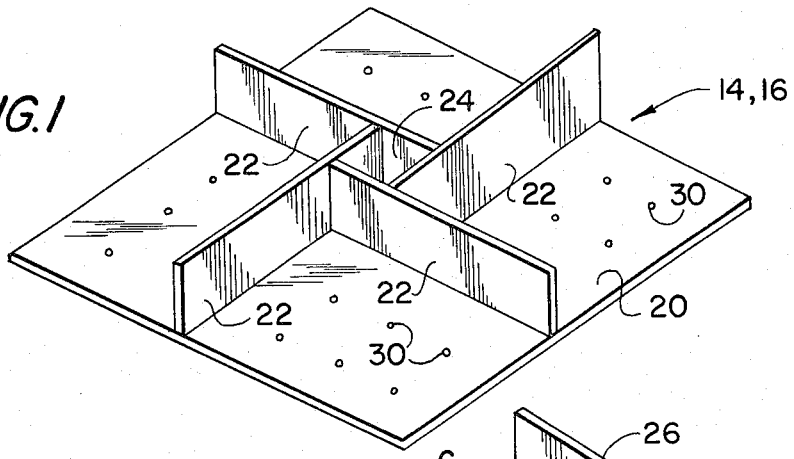
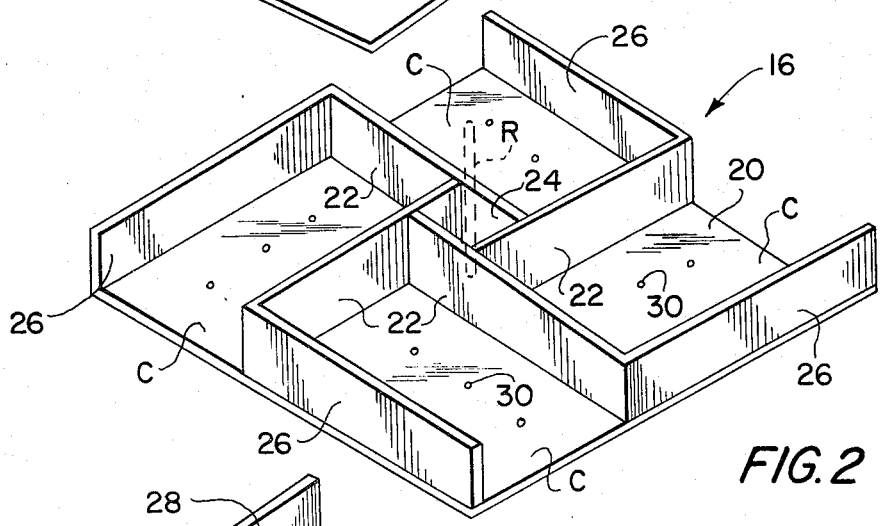
FIG. 2
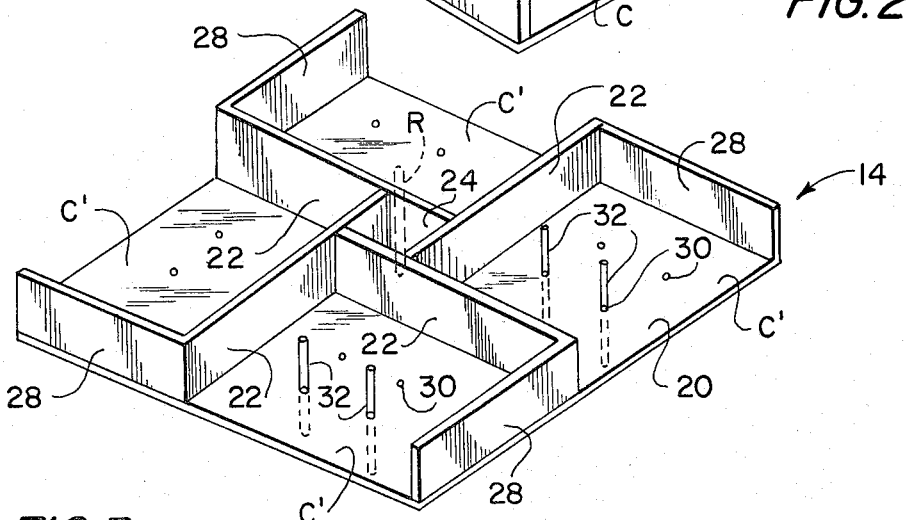
FIG. 3

DEVICE FOR STOCKING, FILING AND DISPLAYING SMALL ARTICLES

BACKGROUND OF THE INVENTION

The present invention relates as indicated to a device for stocking, filing and displaying small articles, and relates more particularly to a cabinet in which a relatively large stock of articles can be kept in a limited space and in which the articles contained in the cabinet can be readily displayed. The invention is particularly designed for containing and displaying small articles such as buttons, but it will be apparent that other types of articles can be contained and displayed as well.

Presently, buttons are normally sold at the retail level either in plastic envelopes or packages or on cards in which the buttons are hand sewn. Both of these packaging forms are relatively expensive and are necessarily reflected in the cost of the buttons at the retail level. In addition, the cards or plastic wrappings require substantial space for proper display, and are displayed in such a manner that it is difficult for the customer to inspect the stock and select the desired article. A further form of merchandising buttons is by plastic tubes having caps which are removable and into which the buttons are stored. The tubes can be of different diameters and can be stored either in an upright or horizontal position. This form of stocking likewise requires a large display area, and the tubes are not easy to handle because of their size and shape.

SUMMARY OF THE PRESENT INVENTION

With the above in mind, a primary object of the present invention is to provide a device in the form of a cabinet in which the button articles can be stocked and displayed to facilitate selection of the stock and removable of the same from the storage device. In accordance with the invention, the storage device is in the form of a cabinet containing a number of superimposed discs all of which are rotatable about a stationary base member. Each disc is constructed and arranged to receive a plurality of individual cases in which the buttons are stored. Each disc is divided internally into five compartments, four of which are further subdivided into sub-compartments for receiving the cases in which the buttons are contained. The compartments in each disc include a central, relatively small compartment through which a supporting rod extends for aligning the superimposed discs and permitting rotation of the same about the axis of the rod and relative to the stationary base. Alternating discs are identically constructed so that the exposed periphery of each disc differs from the disc immediately above or below such disc thereby to facilitate display of the buttons in the exposed ends of the cases positioned in the discs. The walls of each disc extend vertically upwardly and define the height of the disc, with the walls being secured to a flat bottom wall member.

A further object of the invention is to provide a novel means for subdividing each compartment in the disc thereby forming sub-compartments into which the cases can be inserted. In accordance with the invention, the flat bottom wall of each disc is perforated in the area of each compartment so as to accommodate vertical, metal rods which extend vertically through the aligned perforations in the several superimposed discs. In the form shown, six perforations are provided in each rectangular compartment thereby dividing such compartment into 12 identical squares when the metal rods are vertically positioned through the aligned perforations in the discs. The aligned rods subdivide the compartment by forming in effect partitions for receiving the cases containing the buttons.

A still further object of the present invention is to provide cases for containing the buttons in which the cases are shaped so as to be received in each sub-compartment, and in which the case is formed with a hinged lid exposed at the exterior of the case for access to the interior of the case. The cases correspond in length to the length of the compartment in which they are inserted, and the hinged lid is perforated to display the buttons contained in the case.

These and other objects of the invention will become apparent as the following description proceeds in particular reference to the application drawings.

BRIEF DESCRIPTION OF THE APPLICATION DRAWINGS

FIG. 1 is a perspective view of a partially completed disc, showing the upstanding partition walls which define four compartments of substantially the same area and a central, smaller compartment;

FIG. 2 is a perspective view similar to FIG. 1 further including peripheral walls joined to the upstanding partition walls of FIG. 1 to define the four compartments;

FIG. 3 is a view similar to FIG. 2 showing, however, the peripheral walls placed at different locations around the periphery of the discs.

DETAILED DESCRIPTION OF THE PREFERRED EMBODIMENTS

Figure 4:
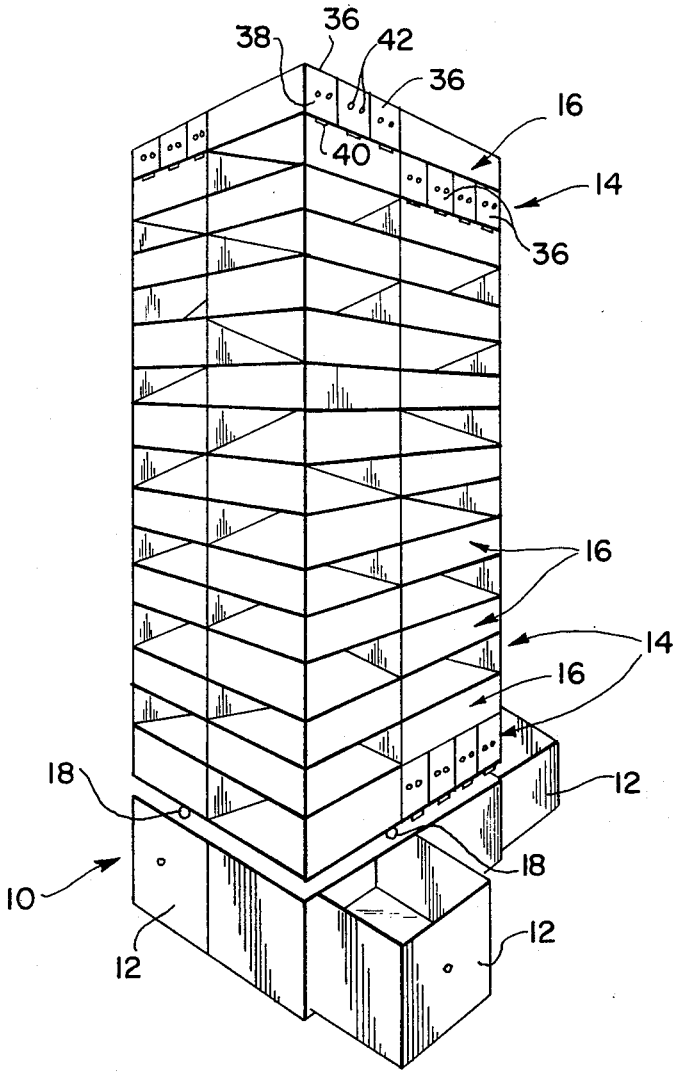
FIG. 4 is a perspective view of the display stand constructed in accordance with the present invention and incorporating therein the discs illustrated in FIGS. 2 and 3.

The stand constructed in accordance with the present invention is shown in FIG. 4 and comprises a base generally indicated at 10 which includes drawers commonly indicated at 12 which are normally stored within the base but can be pulled out as illustrated for access to the contents of the drawers, which contents may comprise, for example, extra stock for the display device. Positioned on the base are a plurality of superimposed discs, with one group of alternate discs being generally indicated at 14 and a second group of alternate superimposed discs being generally indicated at 16. As illustrated, a disc 14 is lowermost of the superimposed discs, with discs 14 and 16 thereafter alternating vertically throughout the height of the stand.

Positioned between the lowermost disc 14 and the base 10 are ball bearing members schematically and commonly shown at 18 for simultaneous rotation of all of the discs about an axis generally centrally of the discs as will be hereinafter described when particular reference is made to FIGS. 1–3. The display case can therefore be rotated so as to view all four sides thereof from a common vantage point.

Referring now to FIG. 1, the basic construction of the disc is illustrated therein, with the disc in FIG. 1 forming a basic unit for both the disc 14, shown in FIG. 3, and a disc 16, shown in FIG. 2. The disc comprises a flat bottom wall 20 and four upstanding partition walls commonly designated at 22. The length of the walls 22 exceeds half the dimension of either the length or the width of the flat bottom wall 20, which is square in the form shown, whereby arrangement of the partition walls as shown in FIG. 1 defines four rectangular compartments of substantially equal size and a central compartment 24 which is of relatively small size. It will be noted that the relatively larger compartments thus formed are opened along the entire periphery of the bottom wall 20.

Referring to FIG. 2, to complete the disc 16, additional upstanding walls commonly designated at 26 are joined to the partition walls 22 at the outer free ends thereof thereby to define three walls of each compartment, designated C in FIG. 2. Each compartment C remains open at one end, with the open end being spaced at equal distances around the periphery of the bottom wall 20.

The formation of the completed disc 14 as shown in FIG. 3 is generally similar to disc 16 shown in FIG. 2, except that the additional outer walls, commonly shown at 28, are joined to the inner partition walls 22 at different locations around the periphery of the bottom wall 20. Thus, in the completion of the disc 14, the outer walls 28 are positioned at locations corresponding to the open ends of the compartment C in FIG. 2, and the open sides of the compartment C′ in FIG. 3 correspond in location to the outer peripheral walls 26 shown in FIG. 2. Thus, when the discs 14 and 16 are superimposed in the orientation thereof illustrated in FIGS. 2 and 3, access to the compartments C and C′ respectively through the open sides thereof are spaced or offset around the periphery of the discs, as shown by the top two discs in FIG. 4. It will further be noted that the depth of the compartments C and C′ differ owing to the positioning of the peripheral side walls, with the compartment C being relatively longer and less wide than the compartment C′ of disc 14, which is wider and not as long.

As above described, the discs 14 and 16 are rotatable about a generally central axis relative to the stationary base 10, and a vertical central rod R, shown in dash lines in both FIGS. 2 and 3, extends through openings formed in the central compartment 24 of each disc, with the openings being aligned when the discs are superimposed to receive the rod. The rod may be secured in the device in any suitable manner.

In order to divide each compartment C and C′ into subcompartments for containing the individual cases in which the buttons are displayed, the bottom wall is formed with a pattern of perforations commonly designated at 30, with the perforations being equally spaced in each compartment and aligned with similar perforations formed in other discs whereby each perforation can be vertically aligned with other perforations throughout the vertical extent of the stand. The spacing rods commonly designated at 32 are adapted to extend through the aligned perforations throughout the heighth of the stand thereby securing the discs together for simultaneous rotation and at the same time serving to subdivide each compartment C and C′ by providing what is in effect aligned partitions internally of each compartment. Although in FIG. 3 four such rods 32 have been illustrated, it will be understood that a similar rod extends through each perforation 30 illustrated, with rods 32 likewise extending vertically through each perforation 30 in disc 16. The rods 32 can be secured to the discs 14 and 16 in any suitable manner.

Cases commonly designated at 36 are disposed in each subdivided compartment C and C′, with each disc being generally rectangular and comprising a front lid or cover 38 which is hinged as shown at 40 to the bottom of the case to permit the lid 38 to be lowered to gain access to the interior of the case. In the form shown, each lid is formed with a plurality of perforations 42 whereby the interior of each case can be viewed.

It will be noted in FIG. 1 that six perforations 30 are formed in each compartment thereby subdividing the compartment into twelve areas of equal size. Of these twelve areas, there are three areas in width in compartment C, FIG. 2, and four areas in width in compartment C′, FIG. 3, with the length of the compartments being respectively longer and shorter in these figures. This accounts for three cases 36 appearing at each corner of disc 16, FIG. 4, and four cases 36 appearing at each side of disc 14. The cases 36 contained in disc 14 are of course shorter than the cases 36 contained in the disc 16.

It will thus be seen that when the discs 14 and 16 are interconnected by rods 32 and filled with cases 36, a convenient display stand is provided. The rotation of the discs about the stationary base permits each side of the discs to be rotated to a common vantage point, and the interior of each case can be viewed through the perforations 42. In addition, each case is preferably labeled so as to indicate the contents of the case. The construction of the discs 14 and 16 and the alternate exposed compartment sides in each of such discs afford a vertically staggered display of the cases, a very attractive display arrangement.

Although in the form illustrated each compartment is subdivided into twelve equal areas, it will be understood that by removing one or several of the metallic rods inside each compartment, the compartment may be subdivided as desired and, in fact, may be left undivided. Thus, base 10 is constructed as disc 16 in FIG. 2, with the partitions and outside walls being greater in height to form a more rigid support for the discs 14, 16. The drawers 12 in base 10 extend the full height of the partition and external walls, and each compartment is not subdivided as are the discs which contain the cases 36.

Although the display stand in accordance with the present invention has been specifically designed for displaying buttons, it will be apparent that the invention may be employed for the display of articles of many types where stocking by series is necessary. It will also be apparent that the display stand could be fixed in position on the base 10, and could provide simply open compartments which do not receive either cases or drawers. Thus, the concept of the invention provides great flexibility in design and use.

I claim:

1. A stand for containing and displaying a plurality of small articles comprising a. base means for supporting said device, b. a plurality of individual discs stacked in superimposed position on said base means for rotation relative thereto, each of said discs including a flat bottom wall and a plurality of upstanding partitions which are spaced to define a plurality of compartments and which define the height of the disc, at least one side of each compartment being entirely open, c. rod means extending vertically through said discs for defining in each of said disc compartments smaller sub-compartments of predetermined size, d. cases adapted to contain the articles to be displayed inserted in each sub-compartment and exposed at the exterior of the disc for display and removal of the articles, and e. means for supporting said discs on said base so as to provide rotating movement of said discs relative to said base.

2. The stand of claim 1 wherein there are four upstanding partitions which define four compartments of equal dimension and a relatively small central compartment, and additional upstanding walls which are located in spaced relation around the periphery of the disc and which serve to define the open side of each compartment, said means for supporting said discs for rotating movement on said base comprising a rod which extends upwardly through aligned openings in the central compartments of the superimposed discs.

3. The stand of claim 2 wherein the upstanding peripheral walls of one disc are spaced relative to the upstanding peripheral walls of the discs above and below said one disc whereby vertically alternate rows of compartments are open for receiving said cases.

4. The stand of claim 1 wherein said flat bottom wall of each disc is formed in the area of each compartment with a pattern of openings through which extend said rod means for defining said sub-compartments.

5. The stand of claim 1 wherein said base means includes drawers, and further including bearing means positioned between said base means and the lowermost disc to facilitate rotation of said discs on said base means.

6. The stand of claim 1 wherein each case has a hinged lid for obtaining access to the interior of the case, said lid being forming with perforations to permit viewing of the interior of the case.

* * * * *